United States Patent [19]

Chen

[11] Patent Number: 4,872,211

[45] Date of Patent: Oct. 3, 1989

[54] DUAL FREQUENCY LAUNCHER FOR CIRCULARLY POLARIZED ANTENNA

[75] Inventor: Ming H. Chen, Rancho Palos Verdes, Calif.

[73] Assignee: The United States of America as represented by the Secretary of the Navy, Washington, D.C.

[21] Appl. No.: 242,001

[22] Filed: Aug. 10, 1988

[51] Int. Cl.[4] ..... H01Q 13/00

[52] U.S. Cl. ..... 343/778; 343/776; 333/126

[58] Field of Search ..... 343/778, 781, 786, 776, 343/840; 333/126, 135

[56] References Cited

U.S. PATENT DOCUMENTS

| | | | |
|---|---|---|---|
| 2,566,900 | 9/1951 | McArthur | 343/840 |
| 3,265,995 | 8/1966 | Hamasaki | 333/26 |
| 3,581,311 | 5/1971 | Kach | 343/786 |
| 3,633,110 | 1/1972 | Sullian et al. | 343/786 |
| 4,042,935 | 8/1977 | Ajioka et al. | 343/840 |
| 4,258,366 | 3/1981 | Green | 343/781 P |
| 4,419,670 | 12/1983 | Hill | 343/786 |
| 4,554,552 | 11/1985 | Alford et al. | 343/840 |
| 4,695,844 | 9/1987 | Houchangnia | 343/786 |
| 4,697,192 | 9/1987 | Hofer et al. | 343/895 |

*Primary Examiner*—Rolf Hille
*Assistant Examiner*—Hoanganh Le
*Attorney, Agent, or Firm*—Robert W. Adams

[57] ABSTRACT

A dual frequency antenna feed is formed from a central, circular waveguide connected to the flat boundry of circular, disk-shaped resonant cavity. A second circular waveguide is connected one end of a disk-shaped resonant cavity. Energy of one frequency enters and exits the cavity along the common axis of the waveguides. Energy of the second frequency is introduced to the same resonant cavity by way of a plurality of bandpass filters, also connected to the cavity. This energy enters by way of slots in the cylindrical walls of the cavity. The central circular waveguide is propagating at one frequency but cut off at the second frequency. These bandpass filters are at this pass band for the second frequency, but at the rejection band for the first frequency. Therefore, the isolation between these two input ports are obtained.

5 Claims, 1 Drawing Sheet

DUAL FREQUENCY LAUNCHER FOR CIRCULARLY POLARIZED ANTENNA

BACKGROUND OF THE INVENTION

Dual frequency antenna feed is required in many antenna systems. With dual frequency feed, a single antenna can be used for simultaneous transmitting and receiving, provided that the frequency separatio nis adequate. Alternatively, a separate communications link may be established on the other frequency.

In the prior art, various forms of dual feeders, alsoo known as diplexers, have been used for combining transmit and receive signals in a sinngle antenna. However, these have generally been quite bulky and heavy. Furthermore, for signals that are widely separated in frequency, conventional diplexers are difficult to construct due to the limitations of waveguide design. If the waveguide at the common port is large enough to carry the dominant propagation mode for the lower frequency, it will often be the case that it will be too large to prevent the propagation of undesired higher order modes of the higher frequency signal.

A further limitation in many designs is that they are not easily adapted to circular polarization.

Accordingly, it is an object of the present invention to provide a dual frequency antenna feed or launcher that is compatible with circular polarization.

It is yet another object to provide a dual frequency launcher that is compact and light.

It is yet another object of this invention to provide a dual frequency launcher that does not promote the propagation of undesired waveguide modes at the higher frequency.

These and other objects are obtained in an antenna launcher containing a first central, circular waveguide suitable for use at one frequency, around the axis of which exist a plurality of annular filter cavities tuned to a second frequency, and into which cavities, energy of the second frequency is introduced or withdrawn.

SUMMARY OF THE INVENTION

Dual frequency antenna feed is formed from a central, circular waveguide connected to the flat boundry of cicular, disk-shaped resonant cavity. A second circular waveguide is connected one end of a disk-shaped resonant cavity. Energy of one frequency enters and exits the cavity along the common axis of the waveguides. Energy of the second frequency is introduced to the same resonant cavity by way of a plurality of bandpass filters, also connected to the cavity. This energy enters by way of slots in the cylindrical walls of the cavity. The central circular waveguide is propagating at one frequency but cut off at the second frequency. These bandpass filters are at this pass band for the second frequency, but at the rejection band for the first frequency. Therefore, the isolation between these two input ports are obtained.

DESCRIPTION OF THE PREFERRED EMBODIMENT

Figure 1:
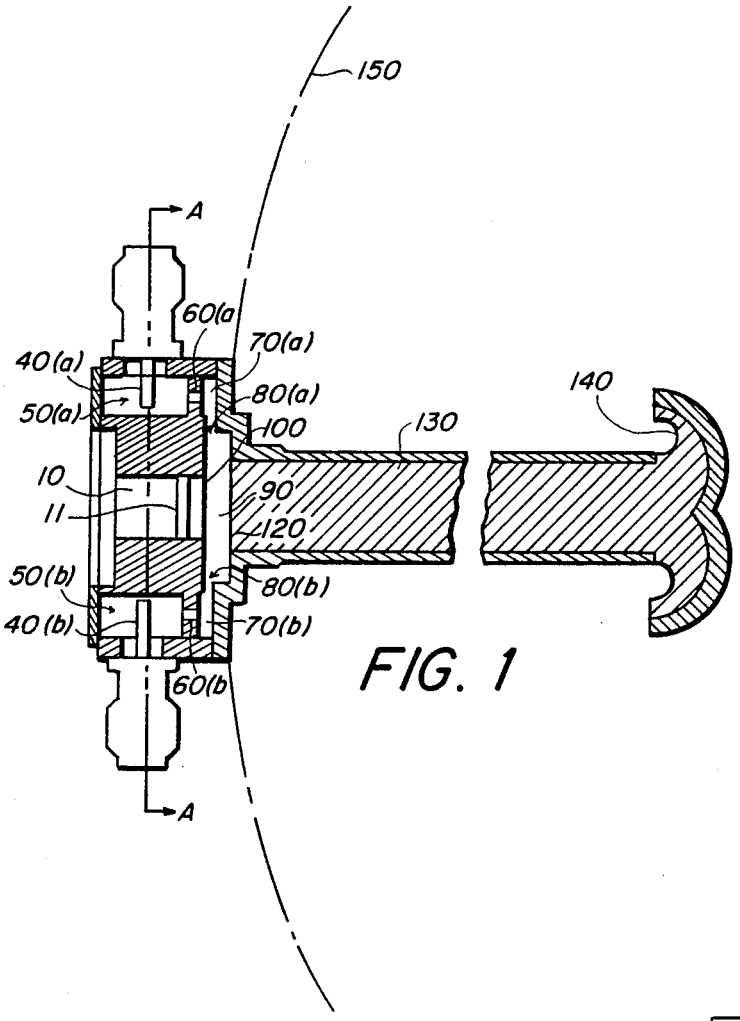
FIG. 1 is a cutaway side view of the dual feed launcher.
Figure 2:
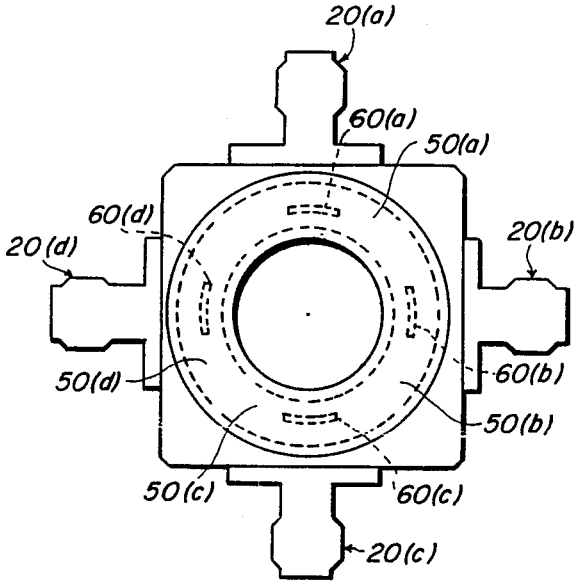
FIG. 2 is a cutaway axial view of the dual feed launcher along line A—A.

The dual band antenna feed, or launcher, shown in FIG. 1, combines Q-band and K-band signals into a common antenna port and maintains isolation between the input ports. Q-band input 10 is a circular waveguide with 0.2 inch diameter. This waveguide is at cutoff for the K-band. Thus, the waveguide itself prevents K-band energy from finding its way into the Q-band input. There is no need for a low pass filter to reject K-band.

The K band input consists of SMA connectors 20*a–d* which are placed at 90 degree intervals about the axis of the circular waveguide. The center conductors of connectors 20*a–d* are extended as voltage probes 40*a–d* into filter cavities 50*a–d*. Each filter cavity is in the shape of a ring segment, located about the same axis as circular waveguide 10, and extending nearly 90 degrees about this axis. Filter cavities 50*a–d* are connected by slots 60*a–d* to filter cavities 70*a–d*. Filter cavities 70*a–d* are, in turn, connected by slots 80*a–d* to filter cavity 90. Filter cavity 90 is in the shape of a cylinder. SLots 80*a–d* allow K-band energy to enter cavity 90 from four directions simultaneously. This allows for multiple phases to be combined so that circularly polarized waves can be launched.

End of 100 of cavity 90 is open to impedance matching annular iris 11, which is, in turn, connected to circular waveguide 10. Opposing end 120 is open to teflon-loaded circular waveguide 130. The opposite end of waveguide 130 is connected to antenna feed-point 140, from whence signal energy is conveyed to or retrieved from dish reflector 150.

Since the waveguide 130 is teflon-loaded, with teflon being a good dielectric, the length of electromagnetic waves traveling in waveguide 130 are shorter than those traveling in input circular waveguide 10. This means that waveguide 130, even if it is the same diameter as the input waveguide 10, can pass frequencies that would be attenuated and in cutoff in waveguide 10. Thus, the size of waveguide 10 itself can be used to exclude K-band energy while waveguide 130, of similar size, can be used to convey K-band energy. A larger wavegude could be substituted for the use of dielectric.

In combination, filter cavities 50, 70, and 90 form a set of four identical 3-pole filters that allow K-band energy to pass, but prevent the passage of Q-band energy. The K-band signals from the 0, 90, 180, and 270 degree connectors 20*a–d* are combined in cavity 90, and are then output to antenna feed-point 140.

The particular shapes and dimensions of the filter cavities 50, 70, and 90 were arrived at through empirical methods in order to arrive at a filter with the correct passband and attenuation characteristics. The second and third filter cavities are in the form of the segments of a thick ring, which ring is co-axial with the central waveguide. All of the second filter cavities, taken together, for a complete ring about the central waveguide. The same is true of the third cavities. The cavities are separated from one another by thin walls of conductor which are parallel to radials directed from the axis of the central, circular waveguide.

It should be noted that the SMA connectors 20 could be replaced with K-band waveguide inputs, or some other form of connector.

The above description is intended to illustrate one preferred embodiment of the invention, and is not meant to limit the scope of the claims which follow.

What is claimed is:

1. A dual frequency antenna feed comprising:

a first circular waveguide;

a cylindrical first filter cavity located at the end of said waveguide on the same axis as said waveguide, oriented such that an end of the cavity connects to an end of said first circular waveguide;

a second circular waveguide connected to the opposite end of the said first filter cavity;

a plurality of second filter cavities, formed inn the shape of ring segments, suitably connected to said first cavity by means of slots in the walls of said first filter cavity;

a plurality of third filter cavities, formed in the shape of ring segments, suitably connected to said second cavities by means of slots in the walls of said second filter cavities; and means for the introduction and withdrawal of energy into said plurality of third filter cavities;

wherein energy of one frequency flows through the said first circular waveguide, and wherein energy of a second frequency flows through said plurality of second and third filter cavities.

2. The dual frequency antenna feed of claim 1 wherein the said means for the introduction of energy fields comprises SMA connectors and voltage probes penetrating the said third filter cavities.

3. The dual frequency antenna feed of claim 1 wherein said means for the introduction of electric fields comprises waveguides suitably connected to said third filter cavities.

4. The antenna feed of claim 1 wherein the said second waveguide is filled with a dielectric material.

5. The antenna feed of claim 4 wherein the said dielectric material is teflon.

* * * * *